US006588871B2

(12) United States Patent
Studholme et al.

(10) Patent No.: US 6,588,871 B2
(45) Date of Patent: Jul. 8, 2003

(54) PRINTER CARTRIDGE KIT AND METHOD

(75) Inventors: John William Studholme, Boston (GB); William John Studholme, Boston (GB); Nigel John Counihan, Boston (GB); Kevin Vickers, Boston (GB); Graham Mottram, Boston (GB)

(73) Assignee: Dynamic Cassette International Ltd., Lincolnshire (GB)

( * ) Notice: Subject to any disclaimer, the term of this patent is extended or adjusted under 35 U.S.C. 154(b) by 0 days.

(21) Appl. No.: 09/735,359

(22) Filed: Dec. 12, 2000

(65) Prior Publication Data

US 2002/0015067 A1 Feb. 7, 2002

(30) Foreign Application Priority Data

Aug. 7, 2000 (GB) ..... 0019404
Nov. 1, 2000 (GB) ..... 0026702

(51) Int. Cl.[7] ..... B41J 29/393; B41J 2/175

(52) U.S. Cl. ..... 347/19; 347/86; 399/12; 711/115

(58) Field of Search ..... 347/5, 19, 14, 347/23, 49, 86, 87; 206/223; 711/115; 399/111, 12, 13; 29/764

(56) References Cited

U.S. PATENT DOCUMENTS

| | | | | | |
|---|---|---|---|---|---|
| 4,442,345 | A | * | 4/1984 | Mollier et al. | 235/380 |
| 4,838,804 | A | * | 6/1989 | Banjo et al. | 439/325 |
| 4,887,161 | A | * | 12/1989 | Watanabe et al. | 348/223 |
| 4,941,700 | A | * | 7/1990 | Lin et al. | 29/764 |
| 5,161,770 | A | * | 11/1992 | Morehouse et al. | 248/632 |
| 5,506,611 | A | * | 4/1996 | Ujita et al. | 347/86 |
| 5,610,635 | A | * | 3/1997 | Murray et al. | 347/7 |
| 5,809,520 | A | * | 9/1998 | Edwards et al. | 711/115 |
| 5,887,145 | A | * | 3/1999 | Harari et al. | 710/301 |
| 6,102,508 | A | * | 8/2000 | Cowger et al. | 347/7 |
| 6,227,638 | B1 | * | 5/2001 | Childers et al. | 347/7 |
| 6,233,408 | B1 | * | 5/2001 | Allen | 399/8 |
| 6,269,225 | B1 | * | 7/2001 | Sato et al. | 396/429 |

FOREIGN PATENT DOCUMENTS

| | | | | |
|---|---|---|---|---|
| EP | 854044 A2 | * | 7/1998 | B41J/2/175 |
| JP | 2000-37880 | * | 2/2000 | B41J/2/175 |

* cited by examiner

*Primary Examiner*—John Barlow
*Assistant Examiner*—Blaise Mouttet
(74) *Attorney, Agent, or Firm*—Kilpatrick Stockton LLP

(57) ABSTRACT

A kit comprises a holder for holding a memory device in the form of a chip, means for inputting data to or altering data in the chip, a printer cartridge for containing ink, and means to retain the chip on the printer cartridge.

20 Claims, 5 Drawing Sheets

PRINTER CARTRIDGE KIT AND METHOD

An ink jet printer cartridge is known which includes a memory device in the form of a chip or EEPROM. The chip stores data which, amongst other things, relates to the ink level of the cartridge and the date of manufacture of the cartridge. When the cartridge is installed in the appropriate printer, the chip is read by the printer. If the data representing the date of manufacture indicates that the cartridge is beyond a certain age, then the printer will warn the user, or simply will not work. Similarly, if the data representing the ink level of the cartridge indicates that the cartridge has too low a level of ink to be used then the printer will not work and an explanatory signal may be given to the user. The printer for the cartridge continually writes to an internal memory as it prints to update data held therein representing the ink level. Once the data indicates that the ink level in the cartridge is below a predetermined threshold, then the printer will not work until the old cartridge has been removed and a new cartridge has been inserted. The spent cartridge cannot be simply removed from then replaced in the printer, as when the spent cartridge is removed from the printer, the data on ink level from the internal memory of the printer is input to the chip on the spent cartridge. Thus, if the spent cartridge is replaced in the printer, or indeed if it is inserted into a different printer, the chip will be read by the printer, the printer will recognise that the cartridge is empty, and will consequently refuse to draw ink from it.

When a cartridge of this type is empty, it can be refilled in the usual way, but the cartridge still will not be accepted by the printer, because the chip will indicate to the printer that the cartridge is empty.

According to one aspect of the invention there is provided a kit comprising a holder for holding a memory device, means for inputting data to or altering data in the memory device, a printer cartridge for containing ink, and means to retain the memory device on the printer cartridge.

In this way, the user can remove the chip from a spent example of the known cartridge, place it in the holder to avoid handling damage, and then reset the chip using the inputting/altering means, and install the chip in the new, full cartridge which will then be accepted by the printer. The data representing the ink level is thus reset so that the printer recognises that the cartridge is now full. Also, the data representing date of manufacture is updated to indicate a more recent date. This enables the chip to be reused because it is reset. It would be possible to refill the spent cartridge and reset the chip but there is an inherent risk of ink spillage in the refilling process which is avoided by use of the kit of the invention, and the quality of printing from a refilled cartridge will inevitably be reduced.

The retaining means may take any suitable form and may comprise a glue, an adhesive tape, a mechanical fixing such as an elastic strap or a screw or screws or any other suitable means. In a preferred embodiment, the retaining means comprises means on the printer cartridge which is arranged to carry the holder with the memory device therein.

According to another aspect of the invention there is provided a kit comprising a holder for holding a memory device, means for inputting data to or altering data in the memory device, and a printer cartridge containing ink, the printer cartridge including means to carry the holder.

The holder may take any suitable form and may define at least one slot, the or each slot receiving an edge of the memory device. In a preferred embodiment, the holder is arranged to contact the memory device on three sides and may be U-shaped. The holder may define a recess in which the memory device is received. The recess may define an undercut at one end. In this way, one end of the memory device can be received in the undercut which will retain it. The holder may be arranged to frictionally hold the memory device between the wall of the undercut and the opposite wall of the recess.

The data inputting/altering means preferably includes a recess which is arranged to receive at least part of the memory device held by the holder. Preferably, the recess of the data inputting/altering means is arranged to receive at least part of the holder. Preferably, the data inputting/altering means is arranged to locate the holder to thereby position the memory device in the data inputting/altering means for data input/alteration thereby.

In one embodiment, the data inputting/altering means includes contacts to contact contacts on the memory device. The contacts are preferably resiliently mounted so as to be biased against the memory device when the memory device is in position with respect to the recess of the data inputting/altering means.

The carrying means of the printer cartridge may take any suitable form and may comprise a glue, adhesive tape, a mechanical fixing such as an elastic strap or a screw or screws or any other suitable means. In one embodiment the carrying means comprises means to receive at least one edge of the holder. Preferably the carrying means comprises means to receive two opposite edges of the holder. The holder may be arranged to be slid into the carrying means or to be received in any other suitable manner. The carrying means may include a stop to prevent sliding movement of the holder and memory device therebeyond.

Preferably the kit also includes means for removing a memory device from a printer cartridge.

Indeed, according to a further aspect of the invention there is provided a kit comprising means for removing a memory device from a printer cartridge, means for inputting data to or altering data in the removed memory device, a printer cartridge for containing ink and means for retaining the memory device on the cartridge.

The retaining means of the printer cartridge may take any suitable form and may comprise a glue, adhesive tape, a mechanical fixing such as an elastic strap or a screw or screws or any other suitable means. In one embodiment the retaining means comprises means to receive at least one edge of the memory device. Preferably the retaining means comprises means to receive two opposite edges of the memory device. The memory device may be arranged to be slid into the retaining means or to be received in any other suitable manner. The retaining means may include a stop to prevent sliding movement of the memory device therebeyond.

According to a further aspect of the invention, there is provided a data inputting or altering device including means for transporting a memory device removed from a cartridge into a data inputting or altering position for data input or alteration by the data inputting or altering device.

The transporting means facilitates use of the data inputting or altering device.

In one preferred embodiment, the transporting means comprises a drawer into the data inputting/altering means. In an alternative embodiment, the transporting means comprises a holder, distinct from the data inputting/altering means, to hold the memory device. The data inputting/altering means may be arranged to locate the transporting means to thereby position the memory device in relation to the data inputting/altering means for data input/alteration thereby.

According to another aspect of the invention there is provided a method comprising the steps of:

placing a memory device in a holder, picking up the memory device by the holder and placing the memory device by means of the holder in the appropriate location for input of data to or alteration of data in the memory device by data inputting/altering means, inputting data to or altering data in the memory device by means of the data inputting/altering means, attaching the memory device to a printer cartridge for containing ink so that the memory device is retained thereon.

Preferably, the memory device is retained on the printer cartridge by retaining the holder on the printer cartridge with the memory device therein.

According to a further aspect of the invention there is provided a method comprising the steps of removing a memory device from a printer cartridge, placing the memory device in a holder, inputting data to or altering data in the memory device and attaching the chip in the holder to a printer cartridge containing ink.

Preferably, the method further includes the initial step of removing the memory device from a print cartridge.

According to another aspect of the invention, there is provided a method comprising the steps of:

removing a memory device from a printer cartridge, inputting data to or altering data in the memory device by means of the data inputting/altering means, attaching the memory device to a printer cartridge for containing ink so that the memory device is retained thereon.

The memory device may be generally planar and may be moved by translation into a recess in the data inputting/altering means.

The data inputting/altering means may alter or input data of any suitable type at any suitable location in the memory device. In a preferred embodiment, in the step of inputting data to or altering data in the memory device by means of the data inputting/altering means, at least part of the data input or altered concerns the ink level in a printer cartridge. In another preferred embodiment, in the step of inputting data to or altering data in the memory device by means of the data inputting/altering means, at least part of the data input or altered concerns the age of the ink in a printer cartridge. In another embodiment, the memory device includes data representing a word or words consisting of a name or trade mark, and in the step of inputting data to or altering data in the memory device by means of the data inputting/altering means, the data representing a word or words consisting of a name or trade mark is altered to null data or to data representing a different word or different words.

According to a further aspect of the invention there is provided a method comprising altering data representing ink level in a memory device on a printer cartridge by means of data inputting/altering means so that the altered data indicates an increased ink level.

According to another aspect of the invention there is provided a method comprising altering data representing the age of ink in a memory device on a printer cartridge by means of data inputting/altering means so that the altered data indicates a lower ink age.

According to a further aspect of the invention there is provided a method comprising altering data representing a word or words consisting of a name or trade mark in a memory device on a printer cartridge by means of data inputting/altering means so that the altered data is null data or data representing a different word or different words.

The method preferably further includes the step of adding ink to the printer cartridge. Preferably the printer cartridge is completely refilled.

Preferably, the method is carried out using a kit or device according to any of the preceding aspects of the invention.

Embodiments of the invention will now be described by way of example and with reference to the accompanying drawings, in which.

Figure 1:
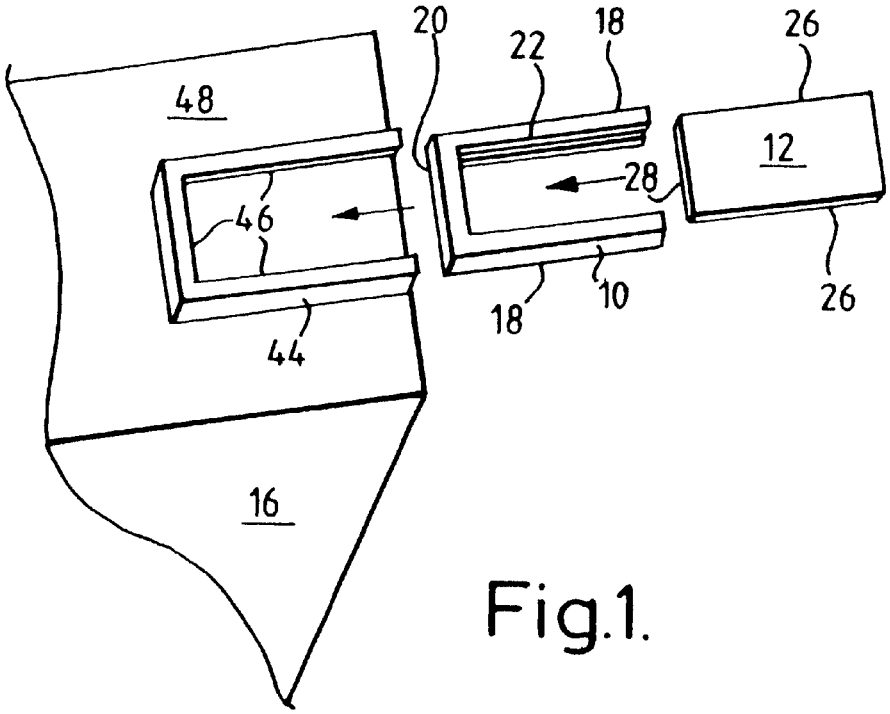
FIG. 1 is an exploded view of a chip and the holder and cartridge of the kit of the first embodiment of the invention.
Figure 2:
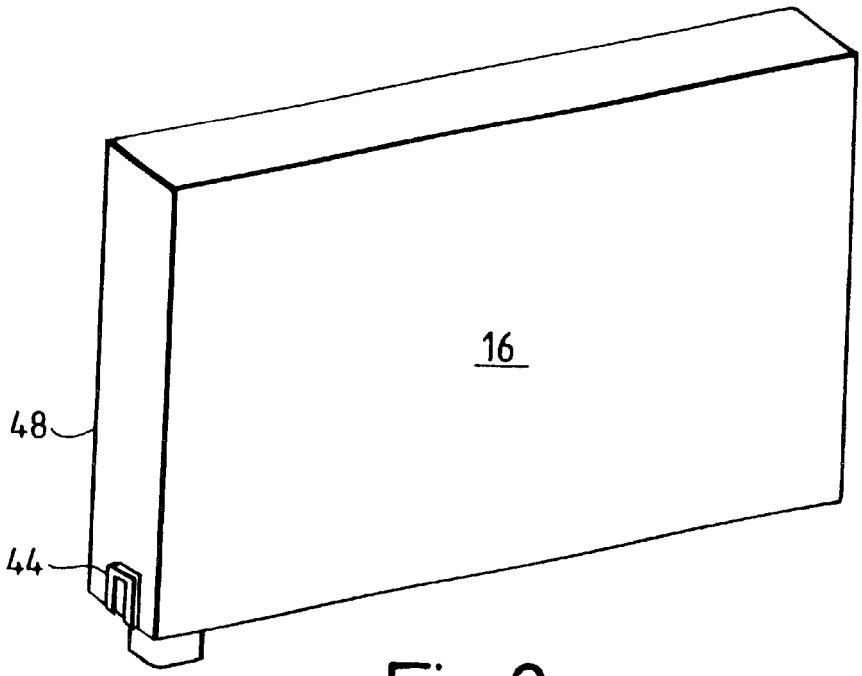
FIG. 2 is a perspective view of the cartridge of the first embodiment.
Figure 3:
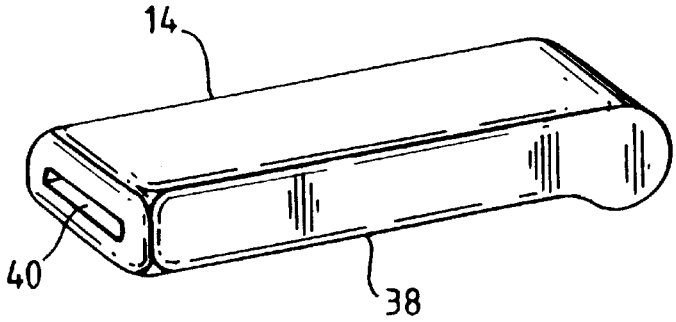
FIG. 3 is a perspective view of the device of the first embodiment for altering the data on the chip.
Figure 4:
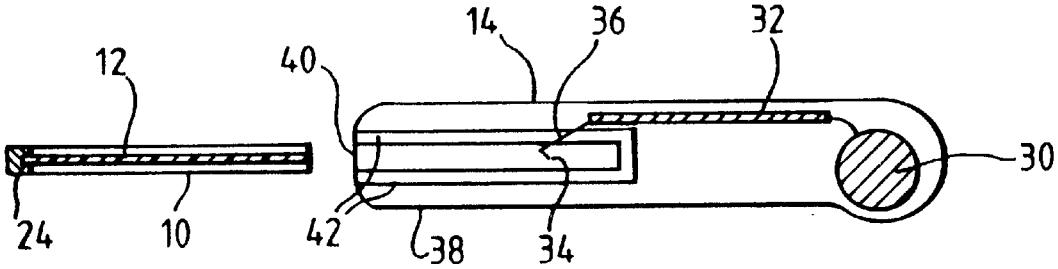
FIG. 4 is a side elevation in cross section of the device of FIG. 3 showing the holder and chip about to be inserted thereinto.
Figure 5:
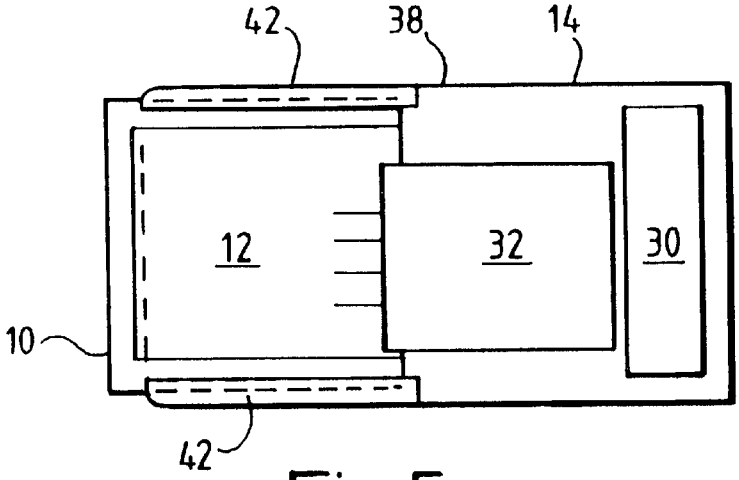
FIG. 5 is a plan view in cross section of the device of FIG. 3 with the holder and chip in position therein.

The kit of the first embodiment of the invention comprises a holder 10 for holding a memory chip 12, a device 14 for altering the data on the chip 12 and a printer cartridge 16 containing ink.

The holder 10 is U-shaped having two elongate limbs 18 connected at one end by a cross piece 20. The holder 10 defines a slot 22, 24 in the inwardly facing sides of each of the limbs and cross piece 20 to frictionally receive three edges 26, 28 of a rectangular chip 12. The holder 10 is so dimensioned that when the chip 12 is fully received in the slots 22, 24, the free edge of the chip 12 lies flush with the free ends of the limbs 18.

The device 14 contains a battery 30 powering circuitry 32 to write to the chip 12 through contacts 34 which are carried on resilient, conductive fingers 36. The casing 38 of the device 14 includes a slot 40 to receive the majority of the chip 12 in its holder 10. The casing 38 defines channels 42 to each side to locate and guide the limbs 18 of the holder 10 as the holder 10 is pushed into the device 14 through the slot 40 by the user. As the holder 10 is pushed in, the chip 12 will contact the contacts 34 which will be pushed upwards against the resilience of the fingers 36. When the holder 10 is fully inserted, the contacts 34 will be in contact with contact pads on the chip 12 and the circuitry 32 will automatically reset the data on the chip 12. The protruding part of the holder 10 consisting of the cross piece 20 can then be grasped and the holder 10 and chip 12 thereby pulled out of the device 14.

The holder 10 and reset chip 12 can then be attached to the printer cartridge 16. The printer cartridge 16 has a U-shaped raised part 44 on its front surface 48 which is undercut around its inner edge to form a groove 46 to frictionally receive the holder 10 with the chip 12 therein. The holder 10 is slid along the front surface 48 of the cartridge 16 into the groove 46 and once fully inserted the chip 12 is in the right position to be read by the printer when the cartridge 16 is installed in the printer.

The use of the holder 10 means that the handling of the chip 12 by the user is minimised to minimise the risk of damage to the chip 12 and reduce the chance of dirt depositing on the chip 12. Also, the holder 10 increases the size and in particular the thickness of the chip 12 rendering it easier to handle.

The kit of the second embodiment of the invention is similar to the first and only the differences from the first embodiment will be described. Thus the device 14 for altering the data on the chip 12 and the printer cartridge 16 containing ink are the same. The kit of the second embodiment further comprises a tool 50 for removing a memory chip 12 from a spent printer cartridge 52, and a different holder 54 for holding the removed memory chip 12.

Figure 6:
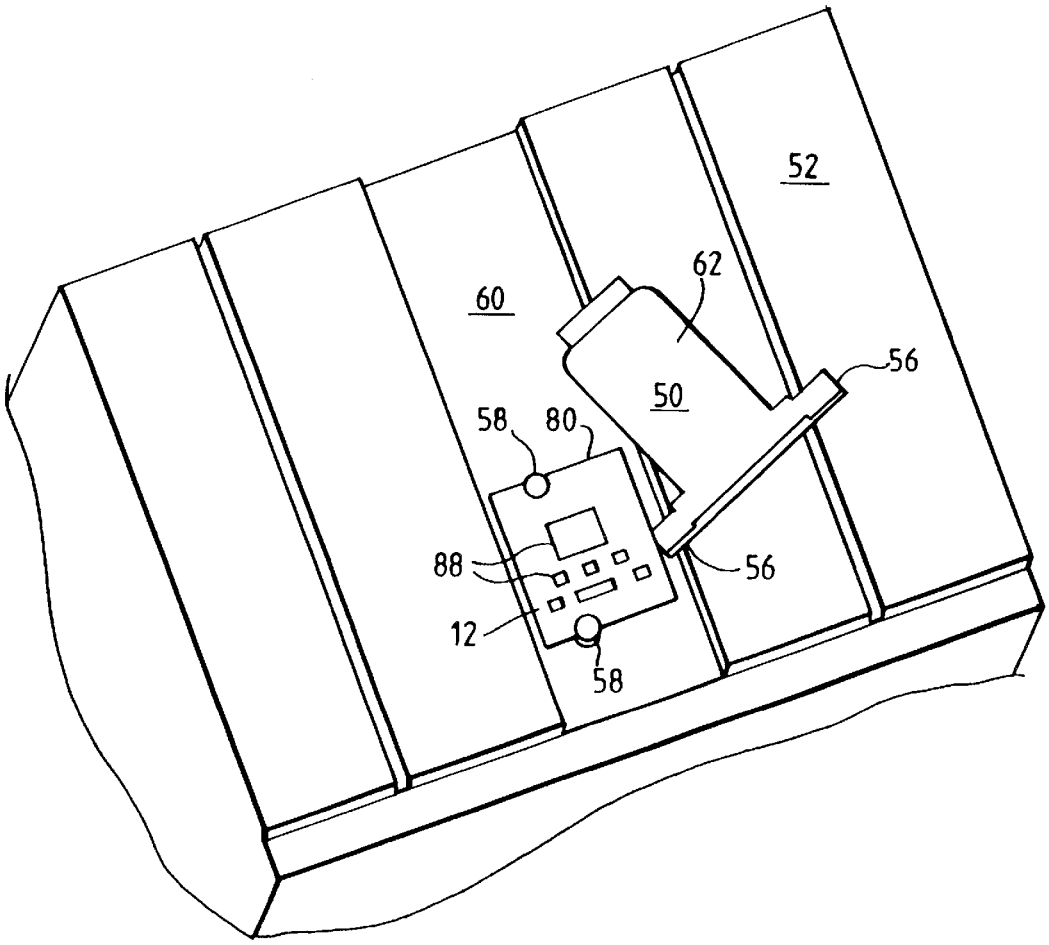
FIG. 6 is a perspective view of the tool of the second embodiment of the invention shown in the position to remove a chip from a spent cartridge.
Figure 7:
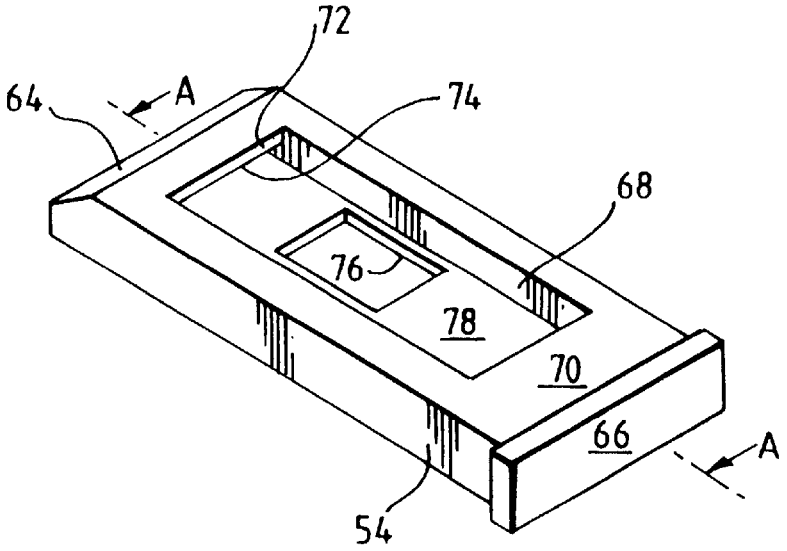
FIG. 7 is a perspective view of the holder of the second embodiment.
Figure 8:
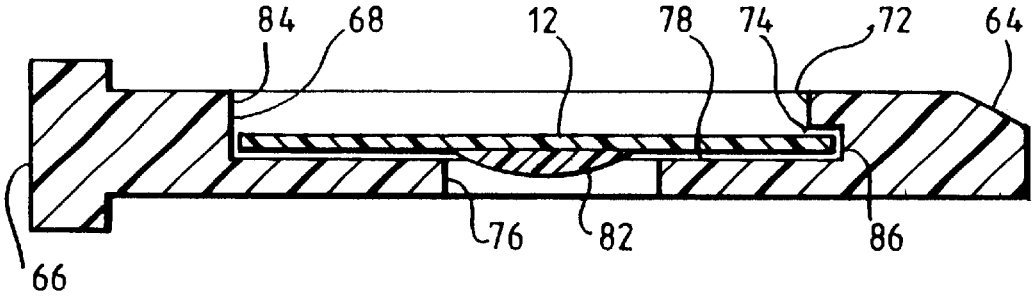
FIG. 8 is a side elevation in cross-section of the holder of FIG. 7 at A–A' in FIG. 8.

The tool 50 is generally T-shaped and includes two opposed spatula ends 56 by means of which the memory chip 12 can be levered off the spent cartridge 52 as shown in FIG. 6. The memory chip 12 is bonded to the ends of two short pillars 58 on the front face 60 of the spent cartridge 52. One tapered spatula end 56 of the tool 50 is inserted between the chip 12 and the front face 60 of the spent cartridge 52 and then levered to force the chip 12 off. The main body 62 of the tool 50 is shaped so that the main body 62 will fit within the data altering device 14 for storage.

The holder 54 of the second embodiment is generally in the form of a rectangular block. The leading edge of the holder 54 includes a tapered surface 64 to aid and guide insertion into the data altering device 14. The rear edge of the main part 65 of the holder 54 is integrally connected to a handle 66 which is wider and taller than the main part 65 of the holder 54 so as to extend beyond the main part 65 of the holder 54 on both sides and to above the upper and lower surfaces of the main part 65. A rectangular recess 68 is defined in the upper surface 70 of the main part 65. The front wall 72 of the recess 68 includes an undercut 74. A rectangular aperture 76 is defined in the floor 78 of the rectangular recess 68. The aperture 76 is approximately centrally arranged in relation to the recess 78 being considerably smaller in length than the recess 68.

In use, the tool 50 is selected and one spatula end 56 is inserted beneath a chip 12 on a spent cartridge 52. The tool 50 is used to lever the chip 12 off the connecting pillars 58. Holding the chip 12 carefully by its edges, the chip 12 is then inserted into the recess 68 in the holder 54 so that the upper edge 80 of the chip 12 is received in the undercut 74 of the recess 68. The chip 12 includes a protective blob of epoxy material 82 which protrudes into the aperture 76 defined in the floor 78 of the recess 68 in the main part. The chip 12 is then held frictionally between the rear wall 84 of the recess 68 and the front wall of the undercut recess 74. With the chip 12 held in the holder 54, the holder 54 is inserted into the data altering device 14 and reset. The holder 54 can be manipulated by means of the handle 66 which also acts as a stop when the holder 54 is inserted into the data altering device 14 to ensure that the contact pads 88 on the memory chip 12 are correctly aligned with the conductive fingers 36. The data altering device 14 alters the data in the chip 12 representing the date of manufacture of the cartridge to data representing a date in the near future. The data altering device 14 alters the data in the chip 12 representing the ink level of the cartridge associated with the chip 12 to replace it with data to indicate to the printer that the cartridge is full of ink. There may be data in the chip 12 to indicate the name or a trade mark of the manufacturer of the cartridge 52. In that case, the data altering device 14 alters the data in the chip 12 representing the name or trade mark of the manufacturer of the cartridge 52 to replace it with null data or with an alternative trade mark or name. The data altering device 14 may emit a signal to indicate that resetting is taking place and/or to indicate that resetting is completed. The signal may be a visual signal for example from an LED (not shown). Once resetting is completed, the holder 54 is removed from the data altering device 14 using the handle 66 and is inserted into the groove 46 of the U-shaped raised part 44 in the front of the full printer cartridge 16, which is then ready for use in the printer from which the spent cartridge 52 was removed.

It can be seen that the fact that the chip 12 is held in the recess 68 in the holder 54 means that it is well protected by the holder 54. In particular, because the size of the chip 12 is less than the size of an average person's finger, the fact that the chip 12 lies in the recess 68 means even if a person places their finger on top of the holder 54, their finger will bridge the recess 68 rather than entering it and so their finger will not come into contact with the chip 12.

The kit of the third embodiment is similar to that of the second embodiment. The same reference numerals are used for equivalent features.

Figure 9:
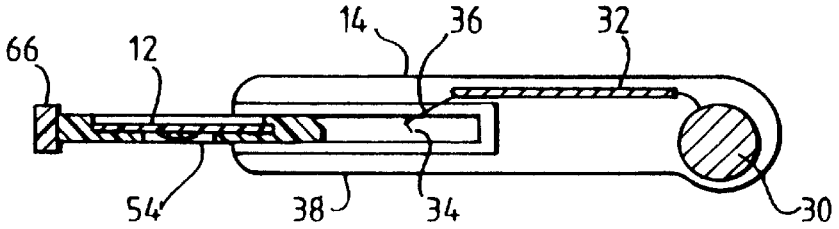
FIG. 9 is side elevation in cross section of the device of the third embodiment.
Figure 10:
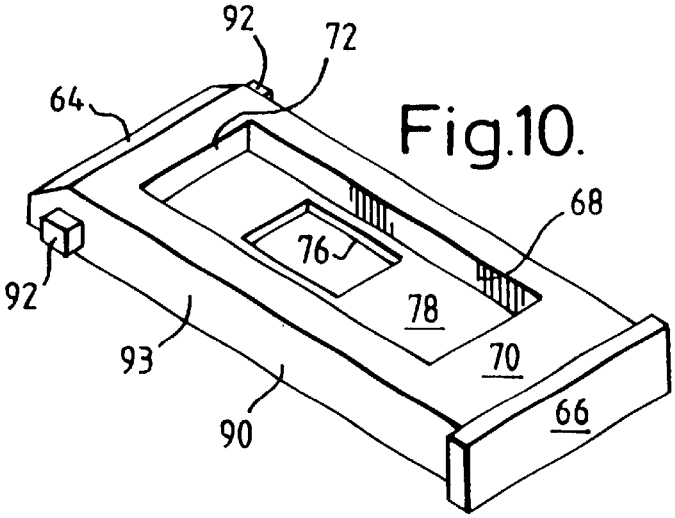
FIG. 10 is a perspective view of the holder of the third embodiment.

The third embodiment, as shown in FIGS. 9 and 10 differs from the second embodiment in that the data altering device 14 has a drawer 90 into which a removed chip 12 can be placed. The drawer 90 is identical to the holder 54 of the second embodiment except that the recess 68 is slightly larger so that it does not frictionally hold the chip 12 but merely locates it adequately for the alignment of the contact pads 88 of the chip 12 with the conductive fingers 36 of the data altering device 14. The recess 68 does not include the undercut 74. Also the drawer 90 has two lateral outwards projections 92 from the side surfaces 93 of the drawer 90 near the leading edge 64 of the drawer 90. The projections 92 engage with stops provided at the ends of the guide channels 42 to prevent the drawer 90 from being pulled completely out of the data altering device 14.

In use then, the chip 12 is removed from the spent cartridge 52 and is placed in the recess 68 of the drawer 90 of the data altering device 14. The drawer 90 is pushed into the data altering device 14 and the chip 12 is reset thereby. The drawer 90 is then grasped by the handle 66 and pulled outwardly to the extent permitted by engagement of the projections 92 with the stops in the guide channels 42 so that the chip 12 can be removed.

The cartridge 16 of the third embodiment is generally similar to that of the first and second embodiments except that the groove 46 defined in the U-shaped raised part 44 is dimensioned to receive the chip 12 itself rather than the chip 12 in a holder 10/54, i.e. it is of narrower width, depth and length.

In the third embodiment then there is not the same protection from handling damage offered by the use of the holders 10 or 54 of the first and second embodiments but there are fewer parts to be lost, as the drawer 90 is attached to the data altering device 14 and cannot be removed.

Figure 11:
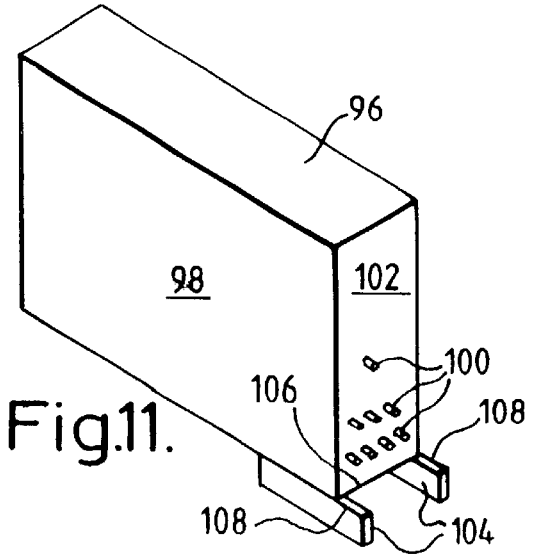
FIG. 11 is a perspective view of the data inputting or altering device of the fourth embodiment; and, FIG. 12 is a front elevation of a refill station of the fourth embodiment.
Figure 12:
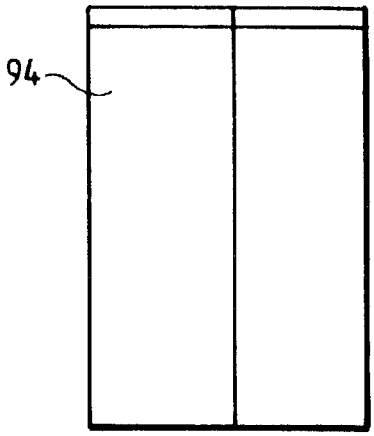

In a fourth embodiment the kit comprises a refilling station 94 of known type and a resetting device 96 as shown in FIGS. 11 and 12. The resetting device 96 consists of a box 98 containing the same elements as the data altering device 14 of the first to third embodiments except that the conductive fingers 36 internal to the data altering device 14 are replaced by sprung conductive pegs 100 extending from the front face 102 of the box 98. The box 98 has two projections 104 which project forwards from the lower edge 106 of the front face 102 of the box 98. The projections 104 have horizontal upper edges 108.

In use, the spent cartridge 52 is refilled in conventional manner using the refilling station 94 and the resetting device 96 is then placed against the front of the spent cartridge 52 so that the upper edges 108 of the projections 104 contact the lower face of the cartridge 52 and so that the pegs 100 align with and contact the contact pads 88. The chip 12 is automatically reset by the resetting device 96 and the refilled cartridge 52 can then be reused.

What is claimed is:

1. A kit for preparing and assembling a cartridge for use in a printer, the kit comprising a holder, adapted for holding a memory device comprising a semiconductor chip for receiving data indicative of the ink level in the cartridge, and by which the memory device can be held by a person to avoid handling damage, means for inputting data to or altering data in the memory device held by the holder, a printer cartridge for containing ink, and means to retain the memory device on the printer cartridge, and wherein the retaining means comprises means on the printer cartridge which is arranged to carry the holder with the memory device therein.

2. A kit as claimed in claim 1, wherein the carrying means of the printer cartridge comprises means to receive at least one edge of the holder.

3. A kit as claimed in claim 1, wherein the carrying means comprises means to receive two opposite edges of the holder.

4. A kit as claimed in claim 1, wherein the holder is arranged to be slid into the carrying means.

5. A kit as claimed in claim 4, wherein the carrying means includes a stop to prevent sliding movement of the holder and memory device therebeyond.

6. A kit as claimed in claim 1, wherein the holder defines at least one slot, the or each slot receiving an edge of the memory device.

7. A kit as claimed in claim 1, wherein the holder is operative to contact the memory device on at least two edges.

8. A kit as claimed in claim 1, wherein the holder is operative to contact the memory device on three edges.

9. A kit as claimed in claim 1, wherein the holder defines a is recess in which the memory device is received.

10. A kit as claimed in claim 9, wherein the recess defines an undercut at one end.

11. A kit as claimed in claim 10, wherein the holder is operative to frictionally hold a memory device between the wall of the undercut and the opposite wall of the recess.

12. A kit for preparing and assembling a cartridge for use in a printer, the kit comprising a holder, adapted for holding a memory device comprising a semiconductor chip for receiving data indicative of the ink level in the cartridge, and by which the memory device can be held by a person to avoid handling damage, means for inputting data to or altering data in the memory device held by the holder, a printer cartridge for containing ink, and means to retain the memory device on the printer cartridge, wherein the data inputting/altering means includes a recess which is arranged to receive at least part of the memory device held by the holder, and wherein the recess of the data inputting/altering means is operative to receive at least part of the holder.

13. A kit for preparing and assembling a cartridge for use in a printer, the kit comprising a holder, adapted for holding a memory device comprising a semiconductor chip for receiving data indicative of the ink level in the cartridge, and by which the memory device can be held by a person to avoid handling damage, means for inputting data to or altering data in the memory device held by the holder, a printer cartridge for containing ink, and means to retain the memory device on the printer cartridge, and wherein the data inputting/altering means is operative to locate the holder to thereby position the memory device in the data inputting/altering means for data/input alteration thereby.

14. A method reusing a memory device comprising the steps of:

placing a previously-used semiconductor memory device in a holder, picking up the memory device by the holder and placing the memory device by means of the holder in the appropriate location for input of data or alteration of data in the memory device by data inputting/altering means and then, inputting data to or altering data in the memory device by means of the data inputting/altering means, and then attaching the memory device to a printer cartridge for containing ink so that the memory device is retained thereon, and wherein the memory device is retained on the printer cartridge by retaining the holder on the printer cartridge with the memory device therein.

15. A method as claimed in claim 14, wherein the method further includes the initial step of removing the memory device from a print cartridge.

16. A method as claimed in claim 14, wherein the memory device is generally planar and is moved by translation into a recess in the data inputting/altering means.

17. A method as claimed in claim 14, wherein in the step of inputting data to or altering data in the memory device by means of the data inputting/altering means, at least part of the data input or altered concerns the ink level in a printer cartridge.

18. A method as claimed in claim 14, wherein in the step of inputting data to or altering data in the memory device by means of the data inputting/altering means, at least part of the data input or altered concerns the age of the ink in a printer cartridge.

19. A method as claimed in claim 14, wherein the memory device includes data representing a word or words consisting of a name or trade mark, and in the step of inputting data to or altering data in the memory device by means of the data inputting/altering means, the data representing a word or words consisting of a name or trade mark is altered to null data or to data representing a different word or different words.

20. A method as claimed in claim 17, wherein the memory device includes data representing a word or words consisting of a name or trade mark, and in the step of inputting data to or altering data in the memory device by means of the data inputting/altering means, the data representing a word or words consisting of a name or trade mark is altered to null data or to data representing a different word or different words.

* * * * *